US006957023B2

(12) United States Patent
Kinoshita et al.

(10) Patent No.: US 6,957,023 B2
(45) Date of Patent: Oct. 18, 2005

(54) IMAGE FORMING APPARATUS, DEVELOPING UNIT AND STORAGE MEDIUM

(75) Inventors: Masahide Kinoshita, Shizuoka (JP); Seiji Yamaguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/667,357

(22) Filed: Sep. 23, 2003

(65) Prior Publication Data

US 2004/0062559 A1 Apr. 1, 2004

(30) Foreign Application Priority Data

Sep. 27, 2002 (JP) ..... 2002-284239
Sep. 11, 2003 (JP) ..... 2003-319809

(51) Int. Cl.[7] ..... G03G 15/08
(52) U.S. Cl. ..... 399/27; 399/29
(58) Field of Search ..... 399/24, 25, 27, 399/29

(56) References Cited

U.S. PATENT DOCUMENTS 5,095,335 A 3/1992 Watanabe et al. ..... 399/111
5,589,918 A 12/1996 Oshida et al. ..... 399/114
5,682,574 A 10/1997 Oshida et al. ..... 399/64
6,131,007 A 10/2000 Yamaguchi et al. ..... 399/256
6,343,193 B1 1/2002 Matsumoto et al. ..... 399/27
6,496,664 B1 12/2002 Ogata et al. ..... 399/62
2003/0091353 A1 5/2003 Hiroshima et al. ..... 399/25

FOREIGN PATENT DOCUMENTS

EP 1055979 A2 * 11/2000 ..... G03G/21/18
JP 63237068 A * 10/1988 ..... G03G/15/00
JP 10-39693 2/1998
JP 2001305809 A * 11/2001 ..... G03G/15/00

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus including a first unit having a developer container holding developer containing toner and carrier, and a developer holder to hold and transfer the developer held in the developer container, a second unit to supply toner to the developer container, and a processing unit to determine the time of replacement of the first unit, from information on a toner supply amount from the second unit or information on an operation amount of the developer holder.

12 Claims, 8 Drawing Sheets

FIG. 5

| PRINTING PERCENTAGE (%) | NUMBER OF PRINT SHEETS UPON OCCURRENCE OF FOG | TONER USE AMOUNT (INTEGRATED TONER SUPPLY AMOUNT) (g) |
|---|---|---|
| 5 | 50000 | 1250 |
| 10 | 50000 | 2500 |
| 20 | 40000 | 4000 |
| 30 | 28000 | 4200 |
| 40 | 21000 | 4200 |
| 50 | 17000 | 4250 |

IMAGE FORMING APPARATUS, DEVELOPING UNIT AND STORAGE MEDIUM

FIELD OF THE INVENTION

The present invention relates to an image forming apparatus and a developing unit attachable/detachable to/from the apparatus. More particularly, the present invention relates to an electrophotographic or electrostatic printing type image forming apparatus, and especially to an image forming apparatus in which the life or time of replacement of a developing device can be determined, a developing unit, and a storage medium provided in the developing unit.

BACKGROUND OF THE INVENTION

Conventionally, upon actualizing of electrostatic latent image formed on an image holder, well-known development using developer including non-magnetic toner and magnetic carrier is made.

In an image forming apparatus using 2-component developing as a kind of this method, 2-component developer is stirred with a developer stirring-transfer member (hereinbelow, simply "stirring member") provided in a developer container, and through frictional charging, the developer is transferred toward a developing sleeve having a fixed magnet roller inside. The developer is further transferred onto the surface of the developing sleeve and supplied to an electrostatic latent image on a image holder, thereby a visible image is formed on the image holder.

In the 2-component developing method, since only toner can be resupplied from a separately-provided toner supply container, the life of the image forming apparatus can be extended. Further, this method is advantageous in terms of running cost.

FIG. 6 shows a cross-sectional view of a general 2-component developing unit. Reference numeral 160 denotes a developer container including 2-component developer, and 161, a developing sleeve as a developer holder. The developing sleeve 161 is a hollow metal sleeve including a magnet roller (not shown) as magnetic field generating means inside. A blade 162 is provided below the developing sleeve 161 in the proximity of the sleeve 161. The developer transferred in accordance with rotation of the developing sleeve 161 in an arrow direction is formed into a thin layer by the blade 162. Then, in a portion opposite to an electrostatic drum 1000, developing is performed in faithfully accordance with the electrostatic latent image on an electrostatic drum 1000.

In the developer container 160, a screw 163 is provided in approximately parallel to the developing sleeve 161, to stir and transfer the developer in the arrow direction. A screw 164 is provided on the opposite side to the developing sleeve 161. Further, a toner density sensor 165 is provided on a wall surface in the rear of the screw 164 (left side in the figure).

FIG. 7 is a cross-sectional view of a developing unit viewed from an upper position. The screws 163 and 164 are provided in approximately parallel to each other. The inside of the developing unit is partitioned with an inner wall 168 to prevent developer from being transferred between the screws 163 and 164. The developing unit has no inner wall at both ends in a lengthwise direction such that the developer can be transferred between the screws 163 and 164. As the screws 163 and 164 transfer the developer respectively in opposite directions, a circular path is formed in the developing container 160 to continuously circulate the developer.

The toner density sensor 165 is provided on the upstream side in the transfer direction on the screw 164, such that it can immediately detect the toner density, which has been lowered after use of toner in image formation. The developer used in image formation on the screw 163 side is sent to the screw 164 side by the above-described circulation, and the toner density is detected by the toner density sensor 165. Then, based on the result of detection, an appropriate amount of toner is resupplied from a toner supply mechanism 169 through a toner supply port 167 on the downstream side of the toner density sensor 165. Thus a predetermined toner density of the developer can be maintained, and a sufficient charging amount can be applied to the toner.

Conventionally, a method for determination of the life of such developing unit by detection of the number of printed sheets has been proposed (e.g., Japanese Published Unexamined Patent Application No. Hei 10-039693).

The determination of the life of the developing unit is important especially in a process cartridge type image forming apparatus. The "process cartridge type" means an arrangement in which constituent elements for a process acting on an electrophotographic photo conductor member, such as an electrostatic drum and a charging unit (including the developing unit), are integrated as a process cartridge attachable/detachable to/from the image forming apparatus main body.

When the life of the process cartridge has expired, it is arbitrarily replaced with a new cartridge, thereby an output image obtained from the image forming apparatus always has a predetermined level of quality. Accordingly, it is important to accurately grasp time of replacement of respective process constituent elements.

However, in the conventional image forming apparatus, a so-called "photographic fog" phenomenon occasionally occurs before expiration of a predetermined life.

It is found from the survey of this problem that photographic fog occurs due to a reduction of the toner charge amount. That is, the triboelectrical-charging capability of the carrier in the developer is extremely degraded before the number of printed sheets becomes the predicted number of sheets upon expiration of the life of the carrier.

The life of the carrier in the developer (use amount) is also influenced by the toner use amount. There is a difference between the life conventionally determined based on the amount of the carrier in the developer, i.e., the number of revolutions of the developing sleeve or the number of printed sheets indicating the number of revolutions of the screw to stir the developer, and the actual life of the carrier in the developer.

SUMMARY OF THE INVENTION

The present invention has been made in consideration of the above problem, and has its object to provide an image forming apparatus, a developing unit and a storage medium provided in the developing unit to prevent degradation of image quality by accurately detecting the use amount of carrier in developer.

According to the present invention, the foregoing object is attained by providing an image forming apparatus comprising: a first unit having a developer container holding developer containing toner and carrier, and a developer holder to hold and transfer the developer held in the developer container; a second unit to supply toner to the developer container; and a processing unit to determine time of replacement of the first unit, from information on a toner supply amount from the second unit or information on an operation amount of the developer holder.

Further, the foregoing object is attained by providing a developing unit attachable/detachable to/from an image forming apparatus, comprising: a developer container holding developer containing toner and carrier; a developer holder to hold and transfer the developer held in the developer container; a storage medium having an area for storing information on a toner supply amount to the developer container and an area for storing information on an operation amount of the developer holder.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a table showing the relation between a printing percentage and the life of a developing unit in the laser-beam printer according to the first embodiment;

DETAILED DESCRIPTION OF THE PREFERRED EMBODIMENTS

Preferred embodiments of the present invention will now be described in detail in accordance with the accompanying drawings. It should be noted that the relative arrangement of the components, the numerical expressions and numerical values set forth in these embodiments do not limit the scope of the present invention unless it is specifically stated otherwise.

(First Embodiment)

Figure 2:
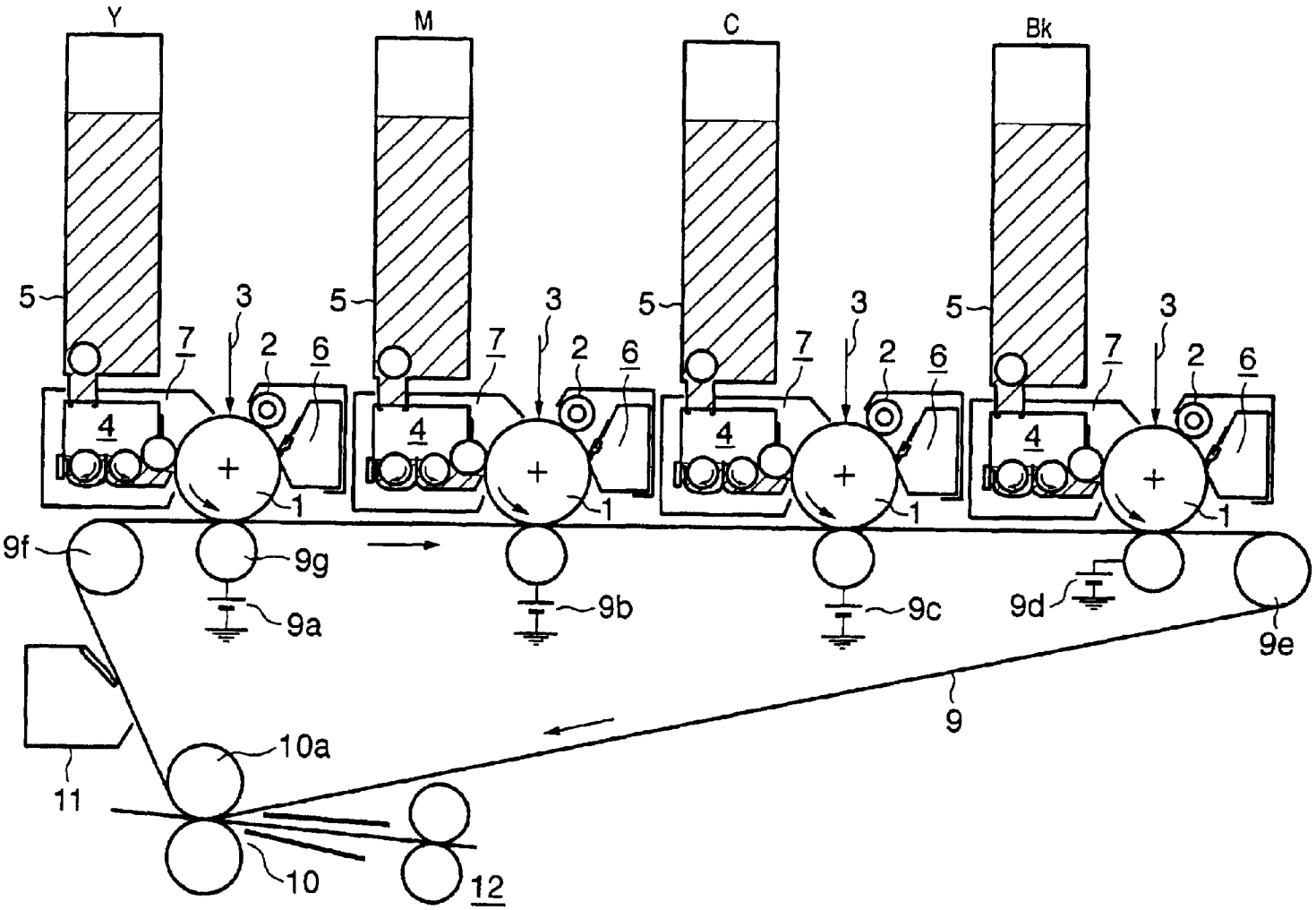
FIG. 2 is a schematic cross-sectional view of a laser-beam printer according to the first embodiment.

A color laser printer as an image forming apparatus according to a first embodiment of the present invention will be described. FIG. 2 is a schematic cross-sectional view of the color laser printer according to the first embodiment.

The color laser printer in FIG. 2 utilizes a transfer-type electrophotographic process by contact charging and inversion developing. Further, a maximum paper size is A4. The printer has plural (4 in the present embodiment) process cartridges 7 (hereinbelow P-CRGs). The printer is a 4-drum (inline) printer which performs temporary multiple-transfer on an intermediate transfer belt 9 as a second image holder and obtains a full-color printed image.

In FIG. 2, the endless intermediate transfer belt 9, put on a drive roller 9*e*, a tension roller 9*f* and a pair of secondary transfer rollers 10, 10*a*, are rotated in an arrow direction in the figure.

The 4 yellow, magenta, cyan and black P-CRGs 7 are serially arrayed on the intermediate transfer belt 9.

Figure 1:
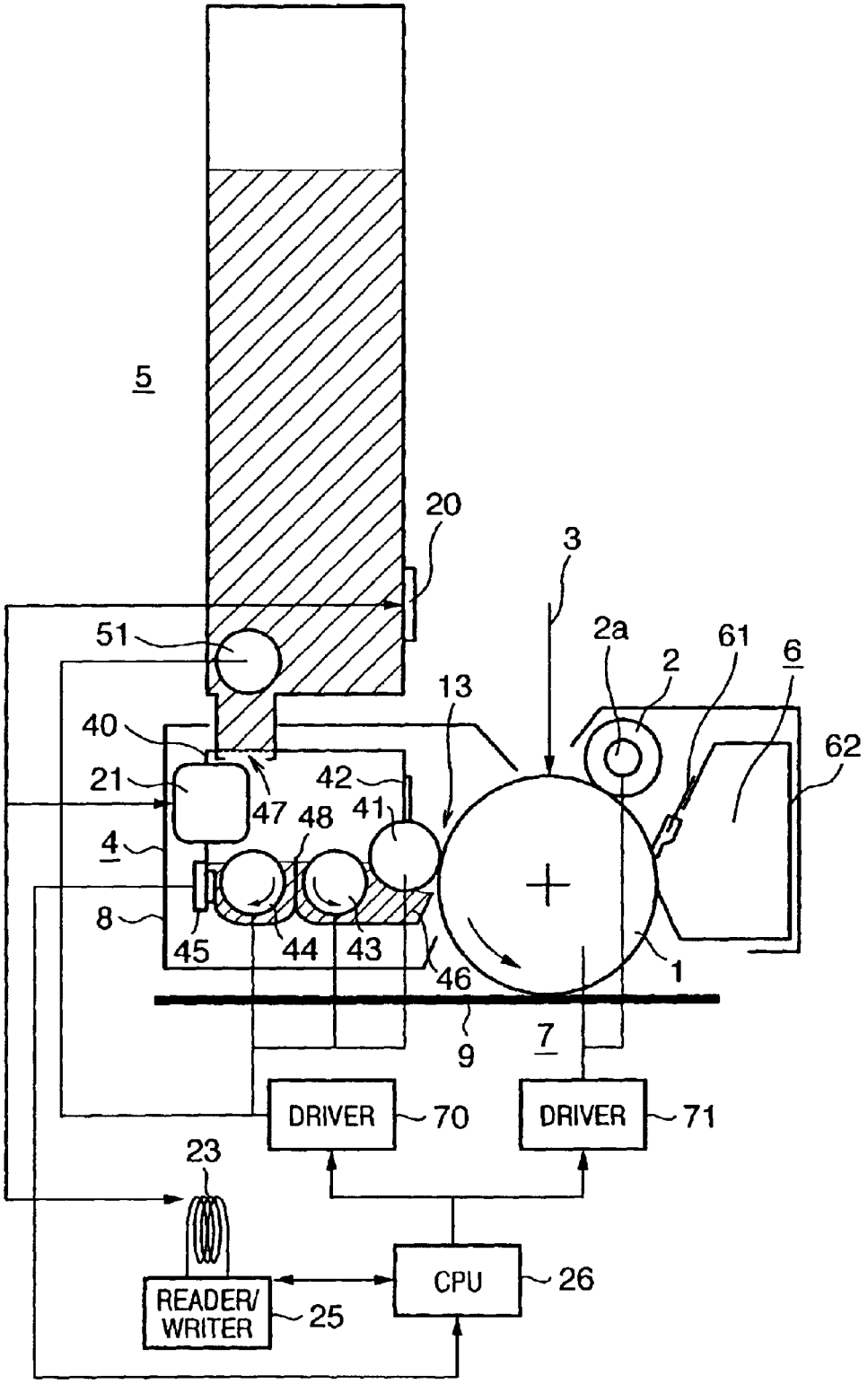
FIG. 1 is a schematic block diagram according to a first embodiment of the present invention.

FIG. 1 schematically shows the construction of the P-CRG taken out of the color laser printer according to the present embodiment. Hereinbelow, the P-CRG 7 will be described with reference to FIG. 1.

In the P-CRG 7, numeral 1 denotes a rotary drum type electrophotographic photo conductor (electrostatic drum) as an image holder. The electrostatic drum 1 is an organic photo conductor (OPC) drum having an outer diameter of 50 mm, which is rotated in the arrow-indicated clockwise direction at a process speed (peripheral velocity) of 100 mm/sec about its center axis. In the electrostatic drum 1, an under coating layer to improve adhesivity of an upper layer while suppressing light interference, a photo-charge generation layer, and a charge transfer layer (with a thickness of 20 $\mu$m) are sequentially formed on the surface of an aluminum cylinder (conductive drum base body).

During the charging process, a predetermined-conditioned voltage is applied to a charging roller 2 as a contact charger, thereby uniformly charging the surface of the electrostatic drum 1 with a negative polarity. In the charging roller 2, having a width of 320 mm, a foam sponge layer, a resist layer as an intermediate layer, and a surface layer as a protective layer, are formed outside a cored bar (support member). In the charging roller 2, a stainless-steel bar having a diameter of 6 mm is used as a cored bar 2*a*, and the surface layer is formed with fluorine-contained resin including suspension of carbon. The charging roller has an outer diameter of 14 mm, and has a roller resistance of 104Ω to 107Ω.

The charging roller 2 holds both ends of the cored bar 2*a* respectively rotatably with bearing members, and presses the cored bar against the surface of the electrostatic drum 1 with a predetermined pressing force. The charging roller 2 rotates in accordance with the rotation of the electrostatic drum 1. A predetermined oscillation voltage (bias voltage Vdc+Vac) obtained by superposing an alternating current voltage at a frequency f with a direct current voltage, is applied from the power source (not shown) via the cored bar 2*a* to the charging roller 2, then the peripheral surface of the rotating electrostatic drum 1 is charged to a predetermined potential.

In the present embodiment, the oscillation voltage is obtained by superposing the direct current voltage; −500V, the alternating current voltage; frequency f=1150 Hz, an inter-peak voltage Vpp=1600 V, and a sine wave. The peripheral surface of the electrostatic drum 1 is uniformly contact-charged to −500V (dark potential Vd).

When the electrostatic drum has been uniformly charged to a predetermined potential with a predetermined polarity by the charging roller 2, the electrostatic drum is subjected to image exposure 3 by an image exposure unit (not shown) (an exposure optical system for color-separation and image-formation from a color original image, a scan exposure system to output a laser beam, modulated in correspondence with a time-sequential digital pixel signal of image information by laser scanning, or the like), thus an electrostatic latent image corresponding to a first color component image (yellow component image) in an objective color image is formed. In the present embodiment, a laser-beam scanner using a semiconductor laser is employed as the exposure unit which outputs a laser beam, modulated in correspondence with an image signal sent from a host device such as an image reader (not shown) to the printer side, to laser-scan expose (image expose) the uniformly-charged surface of the rotating electrostatic drum 1. Upon laser-scan exposure, as the potential in a laser-irradiated portion of the surface of the electrostatic drum 1 is lowered, an electrostatic latent image corresponding to the scan-exposed image information is formed on the rotating electrostatic drum 1. In the present embodiment, the potential of the exposed portion is −150 V.

Next, the electrostatic latent image is developed with yellow toner as a first color by a first developing unit 4 (yellow developing unit).

Next, the developing unit 4 will be described with reference to FIG. 1.

The developing unit 4 is a 2-component contact developing unit (2-component magnetic brush developing device). Reference numeral 40 denotes a developer container; and reference numeral 41 denotes a non-magnetic developing sleeve having a magnet roller (not shown) fixed inside. The developing sleeve 41 is rotatably provided in the developer container 40 with a part of its outer peripheral surface exposed to outside. Reference numeral 42 denotes a developer regulating blade; reference numeral 46 denotes 2-component developer as a mixture of toner and magnetic carrier contained in the developer container 40; reference numerals 43 and 44 denote developer stirring members (screws) provided on the bottom side in the developer container 40; reference numeral 47 denotes a toner supply port; and reference numeral 48 denotes a partition wall. The developer regulating blade 42, provided away from the developing sleeve 41 with a predetermined interval, forms a thin layer of developer on the developing sleeve 41 in accordance with the rotation of the developing sleeve 41.

The developing sleeve 41 is provided to be opposite to the electrostatic drum 1 in the proximity thereof with a constant minimum distance to the electrostatic drum 1 (S-Dgap) of 350 μm. A developing portion 13 is the portion between electrostatic drum 1 and the developing sleeve 41 where these two elements oppose each other. In the developing portion, the developing sleeve 41 is rotated in an opposite direction to a forward direction of the electrostatic drum 1. In the developing portion 13, the thin layer of developer on the developing sleeve 41 comes into contact with the surface of the electrostatic drum 1, and appropriately slide-rubs the surface of the electrostatic drum. A predetermined developing bias is applied from a power source (not shown) to the developing sleeve 41. In the present embodiment, the developing bias to the developing sleeve 41 is an oscillation voltage obtained by superposing a direct current voltage (Vdc) with an alternating current voltage (Vac). More particularly, it is a oscillation voltage obtained by superposing the direct current voltage Vdc=−350 V, the alternating current voltage Vac =1800 V, and a frequency =2300 Hz.

In the developer, coated as a thin layer on the surface of the rotating developing sleeve 41 and transferred to the developing portion, toner is selectively attached to the surface of the electrostatic drum 1 in correspondence with the electrostatic latent image with a magnetic field by the developing bias, thereby developing the electrostatic latent image as a toner image. In the present embodiment, the toner is attached to exposed bright parts on the surface of the electrostatic drum 1 and thus the electrostatic latent image is reverse developed.

The thin layer of developer on the developing sleeve 41 having passed through the developing portion is returned to a developer storage part in the developer container 40 in accordance with the subsequent rotation of the developing sleeve 41.

The developing unit 4 includes the stirring screws 43 and 44 to stir developer. The stirring screws rotate in synchronization with the rotation with the developing sleeve 41, to stir supplied toner and carrier, and supply a predetermined triboelectrical-charging to the toner.

Figure 3:
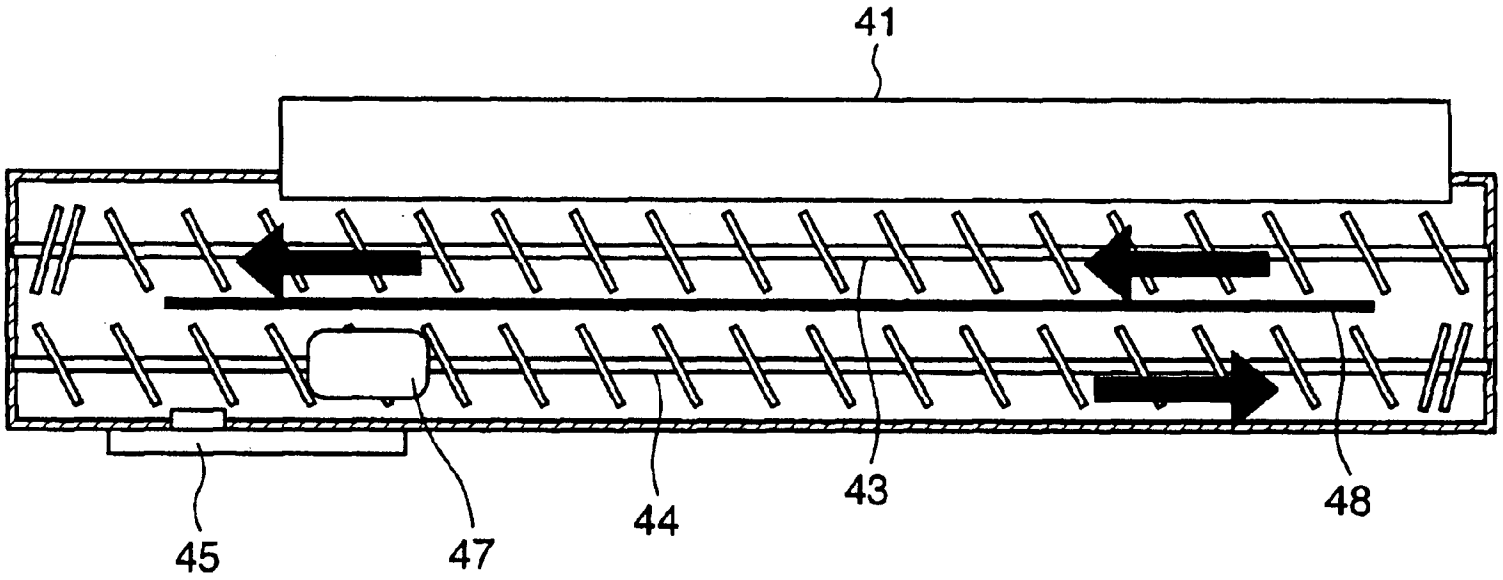
FIG. 3 is a cross-sectional view of a process cartridge in FIG. 1 viewed from an upper position.

FIG. 3 is a cross-sectional view of the developing unit 4 in FIG. 1 viewed from an upper position, showing the status of circulation of the developer and an arrangement in a lengthwise direction. In accordance with rotation of the stirring screws 43 and 44, the developer circulates in arrow directions. A toner density sensor 45 to detect the density of toner in the developer is provided on an upstream side wall surface of the screw 44 in the developing unit 4. The toner supply port 47 is provided on the slightly downstream side of the toner density sensor 45. After a developing operation, the developer is brought to a position around the toner density sensor 45, then the toner density is detected there, and in correspondence with the result of detection, to maintain a constant toner density in the developer, toner is appropriately resupplied through the toner supply port 47 by rotation of a toner supply screw 51 in a developer supply unit (T-CRG) 5. That is, the screw 51 operates as toner discharge means to promote toner discharge from the T-CRG 5. The supplied toner is transferred by the screw 44, mixed with the carrier, supplied with appropriate triboelectrical-charging, then brought to a position around the sleeve 41, then formed into a thin layer on the developing sleeve 41 and supplied for developing.

In the present embodiment, negative charging toner having a mean particle diameter of 6 μm is used as the toner, and silica is added by a part of the weight as an additive agent. Further, magnetic carrier of resin including suspension of magnetic particles having a mean particle diameter of 35 μm, with saturation magnetization of 205 emu/cm$^3$, is employed as the carrier. As the developer, the toner and the carrier are mixed in the ratio of 8:92. The amount of filled developer is 250 g.

In FIG. 2, the yellow image formed on the electrostatic drum 1 is forwarded to a primary transfer nip portion between the drum and the intermediate transfer belt 9. In the transfer nip portion, a transfer roller 9*g* is provided in contact with the rear side of the intermediate transfer belt 9. To independently apply the bias voltage to the transfer roller 9*g* at the respective ports, the transfer roller 9*g* is provided with primary transfer bias sources 9*a* to 9*d*. The intermediate transfer belt 9 first transfers the yellow image at the first color port, then sequentially transfers magenta, cyan and black images, through the above-described process, from the electrostatic drums 1 corresponding to the respective colors, at the respective ports.

In the present embodiment, in consideration of transfer efficiency of toner developed by an exposure portion V1 (potential: −150 V), a voltage of +350 V is applied as a primary transfer bias voltage in all the first to fourth colors. The full-color (4 colors) image formed on the intermediate transfer belt 9 is transferred by a secondary transfer roller 10 onto a transfer sheet P sent from a paper-feed roller 12, and fused there by a fixing device (not shown), thus a color print image is obtained.

In preparation for the next image formation process, the toner remaining from the secondary transfer on the intermediate transfer belt 9 is swept by an intermediate-transfer belt cleaner 11.

As the material of the transfer belt 9, for attaining excellent registration at the respective color ports, elastic material is not desirable, but a belt of resin or a rubber belt including a metal core or a belt of resin and rubber is desirable.

In the present embodiment, the transfer belt 9 is a resin belt of PI (polyimide) having suspension of carbon, with volume resistance controlled to 108 Ω cm. Further, the thickness of the belt is 80 μm, the width of the belt is 320 mm, and the entire perimeter is 900 mm.

Further, the transfer roller 9*g* is made of a conductive sponge having a resistance of 106 Ω or less, an outer diameter of 16 mm, and the width of the roller is 315 mm.

In FIG. 1, a cleaner 6 having a cleaning blade 61 and a waste toner container 62 is provided on the downstream side of the electrostatic drum 1 after the transfer process. As the cleaning blade is provided in contact with the electrostatic drum 1, the toner remaining on the electrostatic drum 1 after the transfer is swept by the cleaning blade 61 into the waste toner container 62.

Then the electrostatic drum 1 is subjected to charging as a next process, and then the above-described operation is repeated.

In FIG. 1, the P-CRG 7 including the electrostatic drum 1, the developing unit 4, the charging roller 2 and the cleaner 6 is formed as a unit with a cover 8 as a casing covering these elements.

The T-CRG 5 and the P-CRG 7 are respectively inserted in a predetermined manner into a predetermined position in the color laser printer by attachment means (not shown), and further, can be removed from the apparatus main body.

The T-CRG 5 and the P-CRG 7 are provided with storage units 20 and 21 for providing information on the life of the T-CRG 5 and the P-CRG 7 or information on the time of replacement to a user. In FIG. 1, the storage units are provided in back positions of the T-CRG 5 and the P-CRG 7.

As the storage units 20 and 21, any storage device can be used as long as it rewritably holds signal information. For example, electrical storage means, such as a RAM or a rewritable ROM, magnetic storage means, such as a magnetic recording medium, a magnetic bubble memory or a magneto-optical memory, may be used.

The schematic construction of the storage unit used in the present embodiment will be described with reference to FIG. 4.

Figure 4:
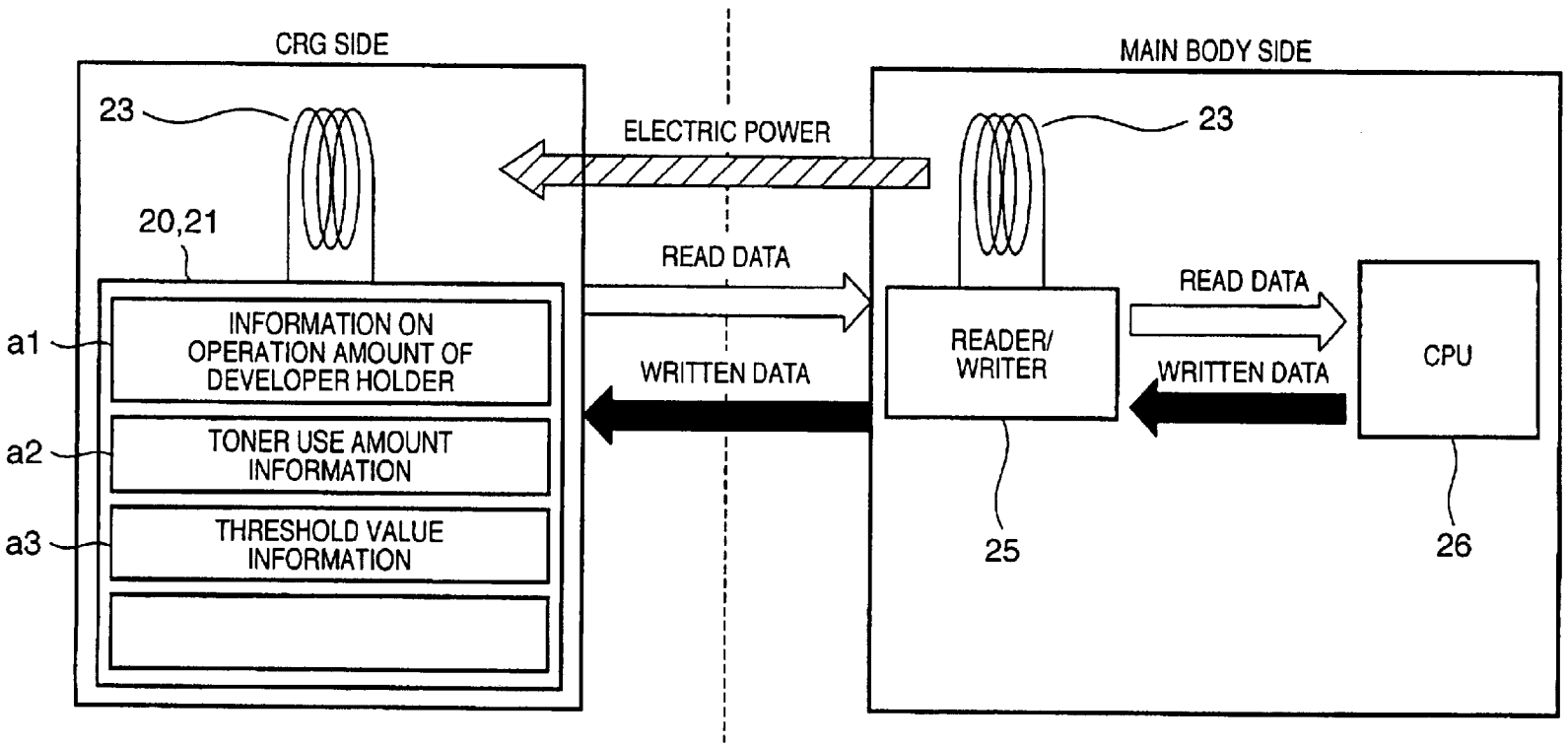
FIG. 4 is a conceptual diagram showing writing and reading to/from a storage unit provided in the process cartridge according to the first embodiment.
Figure 6:
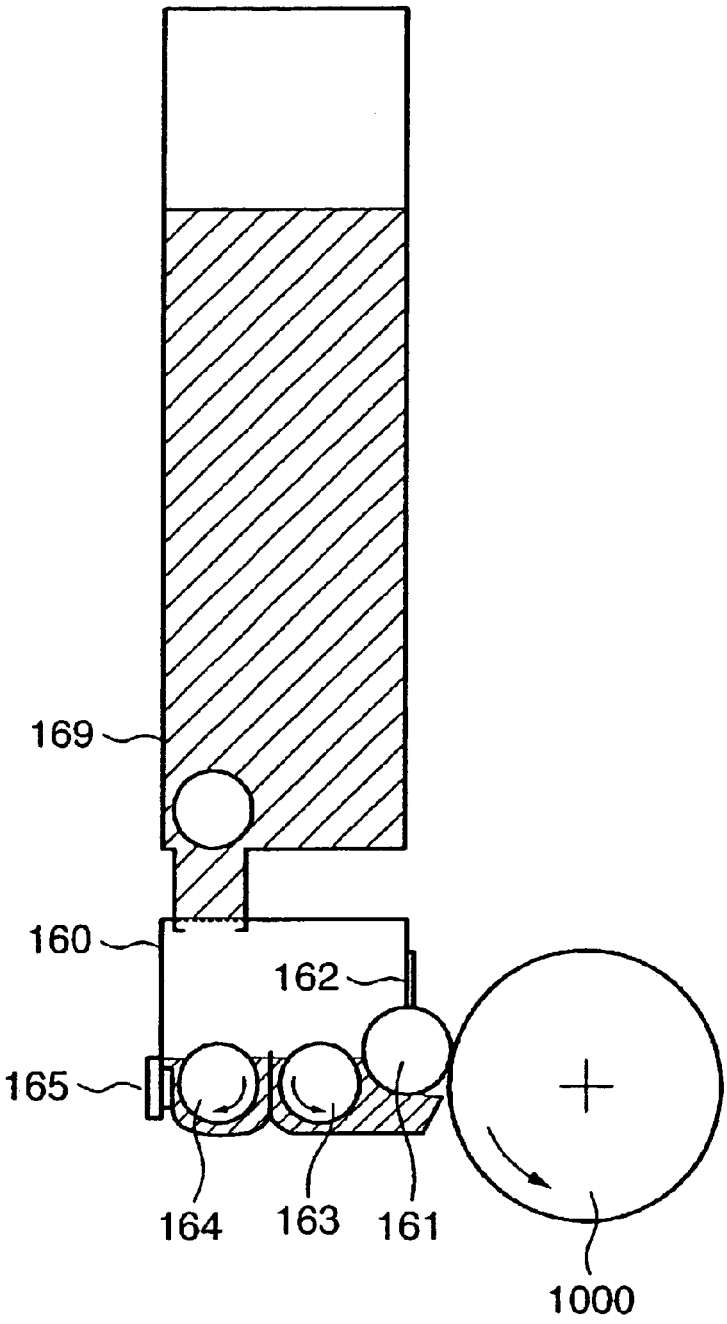
PRIOR ART FIG. 6
FIG. 6 is a schematic cross-sectional view of the conventional developing unit.
Figure 7:
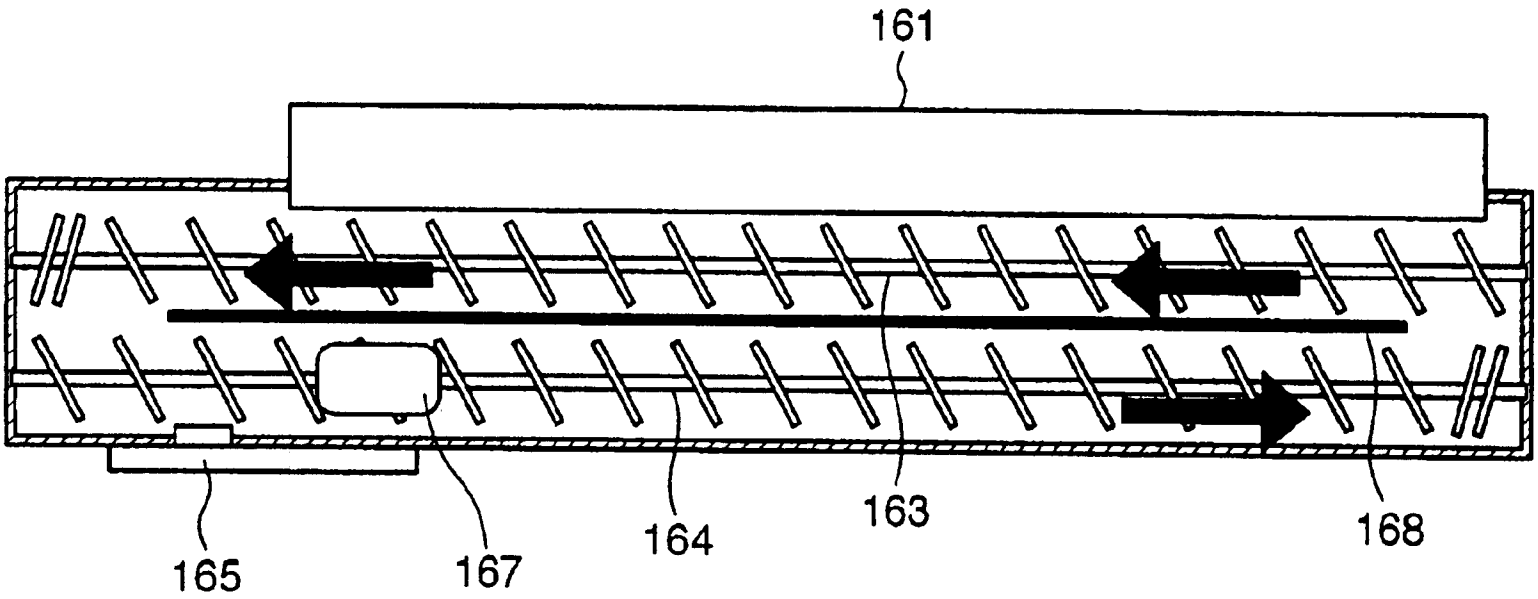
PRIOR ART FIG. 7
FIG. 7 is a cross-sectional view of the developing unit in FIG. 6 viewed from an upper position.

In FIG. 4, by using a combination of resonance circuits having an antenna 23 and a capacitor (not shown), an operation power source is generated from a magnetic wave transmitted from a reader/writer 25 as a data transmission/reception device. Accordingly, communication can be performed without a power source on the cartridge (CRG) side.

In the present embodiment, a nonvolatile memory is used as the storage units 20 and 21. More particularly, a ferroelectric nonvolatile memory (FeRAM) is used as the storage units 20 and 21. Data transmitted from a CPU 26 on the main body side is stored on the FeRAMs 20 and 21 by the reader/writer 25 as the data transmission/reception device, and further, information in the FeRAMs is transmitted to the main body side CPU 26.

The FeRAM has storage areas a1 to a3 for storing information on the number of print sheets, information on the toner supply amount, threshold value information for a determination of the time of replacement of T-CRG 5 or P-CRG 7 and the like. A control signal is transmitted from the CPU 26 via the reader/writer 25 and the antenna 23 of the image forming apparatus main body to the antenna 23 on the cartridge side, and the information is written/read into/from the storage areas of the storage units 20 and 21. Note that in FIG. 1, the storage units 20 and 21 are accessed via one reader/writer 25 and one antenna 23, however, the reader/writer and the antenna may be respectively provided in the storage units 20 and 21.

The toner supply amount from the T-CRG 5 is determined based on a toner density signal transmitted from the toner density sensor 45 in the developing unit 4 to the CPU 26, then the CPU 26 outputs a drive signal to a driving unit 70 such as a motor, to rotate the toner supply screw 51 by an amount corresponding to the necessary toner supply amount.

In the present embodiment, when the toner supply screw 51 rotates once, toner of 200 mg is supplied to the developing unit 4. As described above, if it is determined based on the result of detection by the toner sensor 45 that the toner density is low, a signal requiring toner supply is sent to the CPU 26. The CPU 26 receives the signal, and rotates the driving unit 70, such as a motor, for the toner supply screw 51, thus supplying toner from the T-CRG 5 to the P-CRG 7. At this time, in the present embodiment, the number of revolutions of the driving motor is detected by an encoder (not shown), and the use amount of the toner supply screw 51 is obtained by integrating the number of revolutions. Then, the toner supply amount is determined based on the use amount of the screw 51.

The CPU 26 transmits the number of revolutions of the toner supply screw 51 via the reader/writer 25 and the antenna 23 (FIG. 1) on the image forming apparatus main body side to the reader/writer 25 for the T-CRG 5, to write the data on the FeRAM 20 of the T-CRG 5. In the present embodiment, as the relation between the number of revolutions of the screw and the toner use amount is linear, the remaining toner amount in the T-CRG 5 is detected based on the number of revolutions of the screw. More particularly, in the T-CRG 5, the amount of filled toner is 500 g. Mathematically, if the toner supply screw 51 is rotated 2500 times, the amount of remaining toner becomes zero. Actually, toner of about 20 g remains in dead space in the T-CRG 5, so that the amount of toner becomes zero if the toner supply screw is rotated 2400 times. Accordingly, when the data on the number of revolutions stored in the FeRAM 20 becomes 2400, it is determined that the life of the T-CRG 5 is expired and the user is notified that the toner is exhausted.

Note that in FIG. 1, the driving unit 70 which rotates the toner supply screw 51, also rotates the developing sleeve 41 and the screws 43 and 44. Further, upon image formation, a driving unit 71 (such as a motor) rotates the electrostatic drum 1 and the charging roller 2. The driving unit 71 is separately provided from the driving unit 70, which drives the toner supply screw 51, however, it may be arranged such that those elements are driven by a single driving unit.

Next, a method for detecting the life of the developing unit 4 will be described.

FIG. 5 shows the result of a survey regarding the number of sheets that must be printed to obtain the occurrence of the "photographic fog" phenomenon, i.e., the threshold number of print sheets of the developing unit 4 at which "photographic fog" occurs, thereby indicating the expiration of the life of the developing unit 4, for the purpose of checking the influence of the printing percentage (and the toner use amount) upon the life of the carrier in the developer in the developing unit 4, by actually performing print operations with various printing percentages in an 23° C. /60% RH environment.

In a case where an image with a printing percentage of 5% is continuously printed and in a case an image with a printing percentage of 10% is continuously printed, the number of printed sheets that must be produced for photographic fog to occur is 50,000 in both cases, i.e., the life of the carrier expires when this number of printed sheets is obtained, regardless of printing percentage. Further, in the case of printing with percentages 20%, 30%, 40% and 50%, the number of printed sheets that must be produced for photographic fog to occur is reduced in accordance with the increment in printing percentage. It is apparent from FIG. 5 that in the case of a high printing percentage, one factor that influences the life of the carrier is the integrated toner use amount. FIG. 5 shows the toner use amounts before the expiration of the life of the carrier at the respective printing percentages. At the printing percentages of 20%, 30%, 40% and 50%, when the integrated toner use amount becomes 4000 to 4250 g, the life of the carrier expires. That is, at a 20% or higher printing percentage, the life of the carrier expires when the integrated toner use amount exceeds a predetermined value.

In this manner, at a low printing percentage, the life of the carrier in the developing unit 4 is determined by the number of printed sheets, while at a high printing percentage, the life of the carrier in the developing unit 4 is determined by the integrated toner use amount, since:

① The surface of the carrier is worn away or deteriorated due to mechanical sliding/rubbing, and the triboelectrical-charging capability is degraded.

(2) The surface of the carrier is covered with a melt additive agent in the toner, and the triboelectrical-charging capability is degraded. (The additive agent used in the present embodiment is silica, which has usually the same negative polarity as that of the toner, but here has a reverse polarity with respect to the toner. When the silica is fused to the surface of the carrier, the toner is charged to a positive polarity.)

That is, the life of the developer is equivalent to the life of the carrier. If the triboelectrical-charging capability of the carrier is degraded, the capability of the developer is degraded.

In the case of low printing percentage of 5% and 10%, the life of the carrier expires when the number of printed sheets becomes a predetermined value since the above factor ① is dominant. That is, the use amount of the carrier itself (frequency of use, abrasion and degradation) has a greater influence upon the life of the developer than the influence of the toner upon the carrier.

Further, in the case of high printing percentage, the factor ② is more dominant than the factor ②. That is, upon 1 image formation at a high printing percentage, the amount of toner newly supplied from the T-CRG 5 is larger in comparison with the case of low printing percentage, and since the newly-supplied toner is more frequently brought into contact with the carrier in the developer, the toner greatly influences the carrier. Thus the toner supply amount influences the life of the developer more significantly than the use amount of the carrier itself. Accordingly, it is conceivable that when the amount of additive agent removed from the toner and attached to the carrier becomes equal to or greater than a predetermined value, the life of the carrier expires. It can be easily understood that the toner supply amount and the life of the carrier (use amount) are proportional.

Based on this conclusion, in the present embodiment, the number of printed sheets (the amount of printing material used in image formation) is employed for determination of the use amount of the carrier as a parameter for determination of the life of the developing unit 4, and the toner supply amount is employed for determination of the influence of the toner upon the carrier. Note that the number of printed sheets is counted in A4-size units. If an A3 sheet is used, the number of printed sheets is counted as 2. considering the frequency of mechanical sliding of the developer, the number of revolutions of the sleeve and the number of revolutions of the screw are preferable, however, in the present embodiment, as the rotation of the developing sleeve 41 and that of the screws 43 and 44 are synchronized with each other and these elements are controlled to rotate only during image formation, the number of printed sheets is available here.

More particularly, as a threshold value for determination of the expiration of life or time of replacement of the developing unit 4, the number of print sheets of 50,000 and the integrated toner amount of 4000 are previously stored as threshold information on the FeRAM 21.

These threshold values indicate a status that the triboelectrical-charging capability of the carrier in the developer in the developing unit 4 has been degraded and the degradation of the carrier is at a level of occurrence of photographic fog.

Storage areas for the A4-based number of printed sheets and the integrated toner amount are ensured in the FeRAM 21, and during a print operation, the number of print sheets processed by the developing unit 4 and the amount of supplied toner are integrated. The integrated values are compared with the above previously-stored values, and the life of the developer is determined based on a parameter which has first become a life-expiration threshold value. Note that the integration of the supplied toner amount is performed from the above-described number of revolutions of the screw 51.

Figure 8:
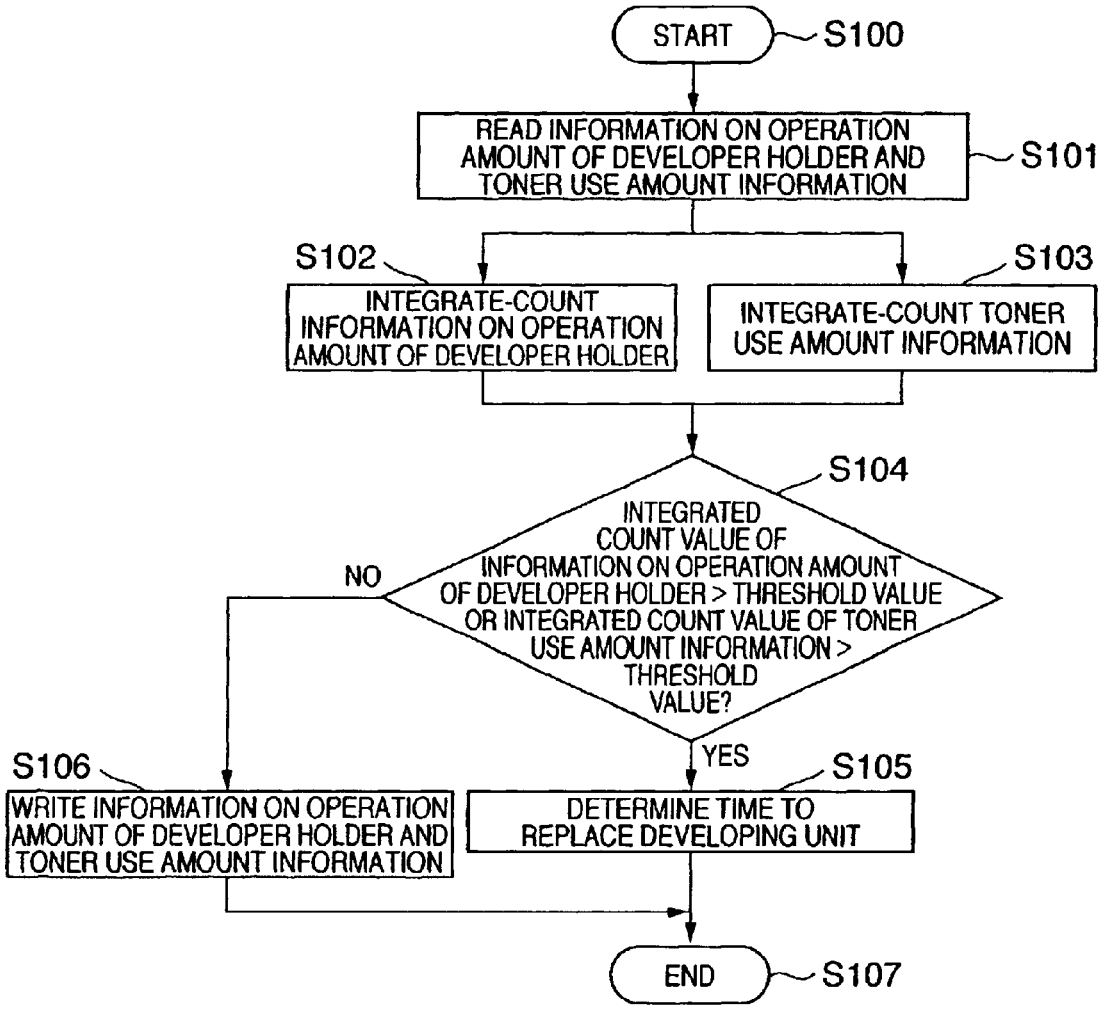
FIG. 8 is a flowchart showing the flow of processing for determination of cartridge time of replacement in the laser-beam printer according to the first embodiment.

The determination is controlled by the CPU 26. Next, the flow of this determination sequence will be described with reference to the flowchart of FIG. 8.

At step S100, the determination control is started, then at step S101, information on the operation amount of the developer holder, and the toner use amount information are read by the CPU 26 from the storage areas of the FeRAM 21 via the reader/writer 25 and the antenna 23. In the present embodiment, as the information on the operation amount of the developer holder, the number of printed sheets is read, and as the toner use amount information, the period of rotation of the toner supply screw 51 as the driving amount is read. Next, image formation is performed, and the number of printed sheets as the information on the operation amount of the developer holder is counted, and integrated with the read value in step S102. At the same time, the period of rotation of the toner supply screw 51 is integrated with the read value at step S103. At step S104, it is determined whether the integrated count value of the information on the operation amount of the developer holder (the integrated count value of the number of printed sheets) is greater than a predetermined threshold value (the above 50,000) or whether the integrated count value of the toner use amount information (the integrated count value of the toner supply screw) is greater than a predetermined threshold value (the above toner amount 4000). If one of the integrated count values is greater than the predetermined threshold value, it is determined at step S105 that it is time to replace the developing unit, and a message notifying the user that the developing unit must be replaced or the like is outputted to a display unit (not shown). Then the process proceeds to step S107, at which the process ends.

At step S104, if the integrated count values are less than the predetermined threshold values, the process proceeds to step S106, at which the respective integrated count values are written onto the storage areas of the FeRAM 21. Then process proceeds to step S107, at which the process ends.

As a result, regardless of the printing percentage, the expiration of the life of the carrier in the developer, i.e., the expiration of the life or the time of replacement of the developing unit 4 can be accurately detected.

Further, as the use amount information is stored onto the FeRAM 21 provided in the P-CRG 7, even in a case where the P-CRG 7 is used in another main body, the expiration of life or time of replacement of the P-CRG 7 can be accurately detected.

Note that in the present embodiment, the toner use amount is calculated from the number of revolutions of the screw 51 of the T-CRG 5, however, it may be arranged such that the number of used T-CRG 5 is stored on the FeRAM 21 of the P-CRG 7. For example, when 8 T-CRGs have been used, it is determined that the life of the P-CRG 7 has expired. However, for more accuracy, it is preferable to integrate the toner use amount from the number of revolutions of the screw. Further, as the toner use amount, the toner amount information required from the toner density sensor 45 of the developing unit 4 may be integrated. In this manner, the toner use amount information may be arbitrarily changed.

Further, in the present embodiment, the number of printed sheets is employed for determining the amount of the carrier in the developer (use amount). However, the determination may be made by detecting the number of revolutions of the developing sleeve 41 or the number of revolutions of the screws 43 and 44.

Further, in the present embodiment, the threshold values are determined respectively for the number of print sheets and the toner use amount, and the expiration of life or time of replacement of the developing unit 4 is determined when one of the integrated values has become the threshold value, however, the present invention is not limited to this arrangement. For example, in correspondence with the expiration of life or time of replacement, a relational expression using the number of printed sheets and the toner use amount is given, and the life can be determined based on the result of calculation.

Further, in the present embodiment, the P-CRG 7 including the electrostatic drum 1, the developing unit 4, the charging roller 2 and the cleaning blade 5 is a removable cartridge. However, it may be arranged such that only the developing unit 4 is removable. In this case, the developing unit 4 is provided with an FeRAM, and the determination of the expiration of life or the time of replacement of the developing unit is similarly performed.

In the above arrangement, the life of the developing unit, i.e., the use amount of the carrier in the developer can be more accurately detected. Further, the user can be notified of the accurate time of replacement so as to use the developing unit completely while preventing the occurrence of photographic fog.

(Second Embodiment)

In this embodiment, the electrostatic drum, the charging roller, the cleaner and the developing unit are integrated as the P-CRG, as in the case of the first embodiment. However, the determination of the end of the life of the cartridge is different.

In the first embodiment, only the life of the developing unit is determined as the determination of the end of the life of the P-CRG. On the other hand, in the present embodiment, the life of the electrostatic drum is also determined, and when one of the life of the developing unit and that of the electrostatic drum has expired, it is determined that the life of the P-CRG has expired.

For the determination of life of the electrostatic drum, a period of rotation of the electrostatic drum and a period of AC bias application to the charging roller are used as parameters, since both the number of revolutions of the electrostatic drum and the period of AC bias application to the charging roller influence the abrasion of the electrostatic drum.

More particularly, assuming that the period of rotation of the electrostatic drum is Td, and the period of AC bias application to the charging roller is Tac, an expression for life determination is given as $$\text{Life determination value } X = Tac + \alpha Td$$

Then, this life determination value Xend is previously stored on the FeRAM provided in the P-CRG, and during actual printing, the Tac and Td values are stored onto the FeRAM. The CPU reads the stored values and compares them with the determined value Xend, thereby determining the life of the P-CRG.

In the above expression, the values a and Xend may be arbitrarily determined in correspondence with conditions or the like of the electrostatic drum, the charging roller and the cleaning blade.

In this manner, as the life of the drum is determined, and further the expiration of life or time or replacement of the developing unit is determined as in the case of the first embodiment, the life of the P-CRG can be more accurately determined from more viewpoints.

(Other Embodiment)

The present invention can be applied to a system constituted by a plurality of devices or to an apparatus comprising a single device.

Note that in the above embodiments, 2-component developer is used, however, the present invention is not limited to this developer, but is applicable to an image forming apparatus using developer containing other component(s) than toner and carrier.

As described above, according to the embodiments, the expiration of life of the developer can be accurately detected and degradation of image quality can be prevented.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

a first unit comprising:

a developer container holding developer containing a toner and a carrier and comprising a stirring member configured and positioned to stir the developer; and a developer holder configured and positioned to hold and transfer the developer held in said developer container;

a second unit configured and positioned to supply the toner to said developer container; and a processing unit configured to determine the time of replacement of said first unit, from information on the amount of toner supplied by said second unit to said developer container or information on an operation amount of said developer holder, wherein said processing unit determines a use amount of the carrier based on the information on the toner supply amount or the information on the operation amount of said developer holder, and based on the result of the determination of the use amount of the carrier, determines whether said first unit should be replaced, and wherein said processing unit calculates the use amount of the carrier from the number of revolutions or period of rotation of said stirring member.

2. The image forming apparatus according to claim 1, wherein said first and second units are removable from said image forming apparatus.

3. The image forming apparatus according to claim 1, wherein said first unit is a process cartridge further including an electrostatic drum and a charging roller.

4. The image forming apparatus according to claim 1, wherein said second unit has a toner supply member configured and positioned to supply the toner to said developer container, and wherein the information on the toner supply amount includes an operation amount of said toner supply member.

5. The image forming apparatus according to claim 4, wherein said toner supply member is a toner supply screw, and wherein said processing unit calculates the operation amount of said toner supply member from the number of revolutions or period of rotation of said screw.

6. The image forming apparatus according to claim 1, wherein said first unit further has a toner density sensor to detect a toner density in said developer container, and wherein said processing unit causes said second unit to supply toner to said developer container in correspondence with the toner density detected by said toner density sensor, and calculates the information on the toner supply amount from a detection value from said toner density sensor.

7. The image forming apparatus according to claim 1, wherein said first unit further comprises:

a storage medium configured the store the information on the toner supply amount or the information on the operation amount of said developer holder; and a data transmission/reception device for said storage medium.

8. A developing unit attachable to an image forming apparatus and detachable from the image forming apparatus, comprising:

a developer container holding developer containing a toner and a carrier;

a developer holder configured and positioned to hold and transfer the developer held in said developer container; and a storage medium having an area for storing information on the amount of toner supplied to said developer container, and an area for storing information on an operation amount of said developer holder, wherein said storage medium further has a storage area for storing threshold information of the toner supply amount or threshold information of the operation amount of said developer holder, and wherein the threshold information of the toner supply amount or the threshold information of the operation amount of said developer holder is information indicating when the life of the carrier expires.

9. The developing unit according to claim 8, wherein the information on the toner supply amount or the information on the operation amount of said developer holder is information indicating a use amount of the carrier.

10. The developing unit according to claim 8, wherein said developing unit is a process cartridge further including an electrostatic drum and a charging roller.

11. A storage medium installed in a developing unit attachable to an image forming apparatus and detachable from the image forming apparatus, wherein the developing unit has a developer container holding developer containing a toner and a carrier, and a developer holder configured and positioned to hold and transfer the developer held in the developer container, and wherein said storage medium comprises:

a storage area for storing information on the amount of toner supplied to the developer container;

a storage area for storing information on an operation amount of the developer holder; and a storage area for storing threshold information of the toner supply amount or threshold information of the operation amount of the developer holder, wherein the threshold information of the toner supply amount or the threshold information of the operation amount of the developer holder is information indicating when the life of the carrier expires.

12. The storage medium according to claim 11, wherein the information on the toner supply amount or the information on the operation amount of the developer holder is information indicating a use amount of the carrier.

* * * * *

UNITED STATES PATENT AND TRADEMARK OFFICE

CERTIFICATE OF CORRECTION

PATENT NO. : 6,957,023 B2
APPLICATION NO. : 10/667357
DATED : October 18, 2005
INVENTOR(S) : Masahide Kinoshita et al.

It is certified that error appears in the above-identified patent and that said Letters Patent is hereby corrected as shown below:

ON THE COVER PAGE:
At (56) References Cited, FOREIGN PATENT DOCUMENTS,
"JP 63237068 10/1988" should read --JP 63-237068 10/1988--.

COLUMN 5:
Line 47, "a" should read --an--.

COLUMN 8:
Line 57 "an" should read --a--.

COLUMN 9:
Line 21, "(2)" should read --②--.
Line 64, "considering" should read --Considering--.

COLUMN 12:
Line 12, "a" should read --α--.

COLUMN 13:
Line 28, "configured the store" should read --configured to store--.

Signed and Sealed this

Fifteenth Day of August, 2006

JON W. DUDAS
*Director of the United States Patent and Trademark Office*